US008206099B2

(12) United States Patent
Tsai et al.

(10) Patent No.: US 8,206,099 B2
(45) Date of Patent: Jun. 26, 2012

(54) ACTIVE AIR FLOW ADJUSTABLE FAN

(75) Inventors: Shang-Yen Tsai, Taoyuan Hsien (TW); Hsin-Chen Lin, Taoyuan Hsien (TW)

(73) Assignee: Delta Electronics, Inc., Taoyuan Hsien (TW)

( * ) Notice: Subject to any disclaimer, the term of this patent is extended or adjusted under 35 U.S.C. 154(b) by 1138 days.

(21) Appl. No.: 12/071,025

(22) Filed: Feb. 14, 2008

(65) Prior Publication Data

US 2008/0267764 A1 Oct. 30, 2008

(30) Foreign Application Priority Data

Apr. 27, 2007 (TW) ..... 96114954 A

(51) Int. Cl.
*F04D 29/46* (2006.01)

(52) U.S. Cl. ..... 415/206; 415/211.2

(58) Field of Classification Search ..... 236/1; 415/126, 415/53.3, 211.2, 224, 58.4, 204, 206, 148, 415/150; 361/695; 62/180; 416/1, 236
See application file for complete search history.

(56) References Cited

U.S. PATENT DOCUMENTS

| | | | | |
|---|---|---|---|---|
| 2,649,242 | A * | 8/1953 | Payne | 415/52.1 |
| 3,351,128 | A * | 11/1967 | Barnd | 165/219 |
| 3,515,345 | A * | 6/1970 | Barnd | 236/1 C |
| 3,940,215 | A * | 2/1976 | Hori et al. | 415/53.3 |
| 4,679,983 | A * | 7/1987 | Pietryk et al. | 415/148 |
| 5,341,650 | A * | 8/1994 | Nagasawa et al. | 62/180 |
| 5,980,199 | A * | 11/1999 | Godichon | 415/1 |
| 6,073,305 | A * | 6/2000 | Hesskamp | 15/405 |
| 7,066,712 | B2 * | 6/2006 | Kim et al. | 415/58.4 |
| 7,100,623 | B2 * | 9/2006 | Assmann et al. | 134/184 |
| 7,614,408 | B2 * | 11/2009 | Park et al. | 134/56 D |
| 8,075,257 | B2 * | 12/2011 | Tien et al. | 415/185 |

* cited by examiner

*Primary Examiner* — Richard Edgar
(74) *Attorney, Agent, or Firm* — Birch, Stewart, Kolasch & Birch, LLP

(57) ABSTRACT

A fan includes at least one fan frame, at least one impeller and at least one active flow-control device. The fan frame includes at least one air inlet and at least one air outlet. The impeller is disposed in the fan frame. The active flow-control device, is disposed on the fan frame for adjusting the size of the air inlet or the size of the air outlet according to demands.

7 Claims, 8 Drawing Sheets

ACTIVE AIR FLOW ADJUSTABLE FAN

CROSS REFERENCE TO RELATED APPLICATIONS

This Non-Provisional Application claims priority under 35 u.s.c. §119(a) on patent application No(s). 096114954, filed in Taiwan, Republic of China on Apr. 27, 2007, the entire contents of which are hereby incorporated by reference.

BACKGROUND OF THE INVENTION

1. Field of the Invention

The present invention relates to a fan and in particular, to a fan which can actively adjust the sizes of all air outlets of the fan during operation.

2. Description of the Related Art

As the systems become miniaturized and integrated, single fan is designed to have more than two outlets to dissipate heat from components in different locations in order to keep a constant temperature in the systems.

However, components release different amounts of heat during operation. For example, during different operating situations such as low, regular or full speed, different high component temperature will occur at different places and different times in the system. Raising the fan speed is the most common way to solve the problem, such that the component with the highest temperature can cooled to be operated normally. However, the disadvantage is that all areas are thus cooled with the same amount of air and energy produced by the fan, resulting in a waste of energy. In addition, it increases noise and decreases the lifetime of the fan.

BRIEF SUMMARY OF THE INVENTION

The present invention provides a fan capable of adjusting sizes of all outlets during operation, and further adjusting the amount of airflows provided through the air outlets accordingly.

The present invention provides a fan that substantially reduces energy waste, lowers noise, and extends the lifetime of the fan.

The present invention provides a fan including at least one fan frame, at least one impeller and at least one active flow-control device. The fan frame includes at least two air outlets. The impeller is disposed in the frame. The active flow-control device, disposed on the fan frame, adjusts the size of at least one of the two air outlets according to demand.

The present invention provides a fan including at least one fan frame, at least one impeller and at least one active flow-control device. The fan frame includes at least two air inlets. The impeller is disposed in the frame. The active flow-control device, disposed on the fan frame, adjusts the size of at least one of the two air inlets according to demand.

The present invention provides a fan including at least one fan frame, at least one impeller and at least one active flow-control device. The fan frame includes at least one air inlet and at least one outlet. The impeller is disposed in the fan frame. The active flow-control device, disposed on the fan frame, adjusts the size of the air inlet or the size of the air outlet according to demand.

As described above, because the active flow-control device is disposed at the air inlet or the air outlet, the size of the air inlet or size of the air outlet can be adjusted according to demand, and the amount of air flowing through the air inlet or the air outlet can be controlled.

Additionally, when the fan includes more than one air inlet or air outlet, the active flow-control devices are disposed at each air inlet or air outlet. As a result, the amount of air flowing through every air inlet or air outlet is thus controlled during operation. It reduces energy waste, noise and extending the lifetime of the fan.

BRIEF DESCRIPTION OF THE DRAWINGS

The present invention can be more fully understood by reading the subsequent detailed description and examples with references made to the accompanying drawings, wherein.

DETAILED DESCRIPTION OF THE INVENTION

Figure 1:
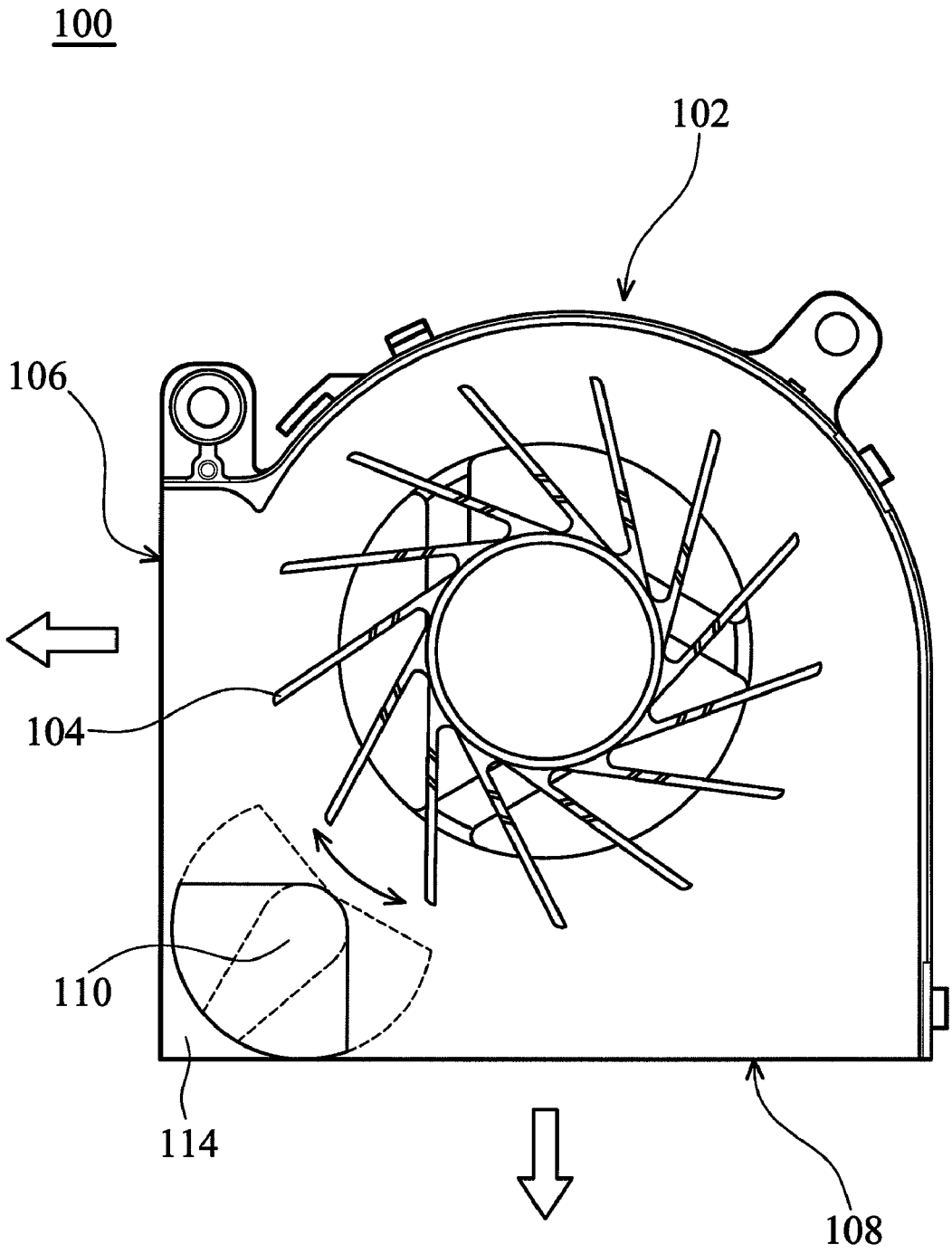
FIG. 1 is a schematic illustration of a first embodiment of a fan.

FIG. 1 is a schematic illustration of a first embodiment of a fan of the present invention. The fan 100 includes at least one fan frame 102, at least one impeller 104 and at least one active flow-control device 110. The fan 100 is a centrifugal fan, for example. The fan 100 connects to a system, and controls speed of the impeller according to a control command of the system or the fan 100 itself.

The fan frame 102 includes at least one air inlet and at least one air outlet. In the embodiment, even though the fan frame 102 includes one air inlet 112 and two air outlets 106, 108, it is not limited thereto. The fan frame 102 can also include at least two air inlets. The fan frame 102 can be formed by a single housing or the fan frame 102 can also be formed by two assembled housings.

The impeller 104 is disposed in the fan frame 102 for sucking air through the air inlet and blowing air from the air outlets 106, 108. The impeller 104 includes at least one curved or plate-shaped blade.

Figure 7:
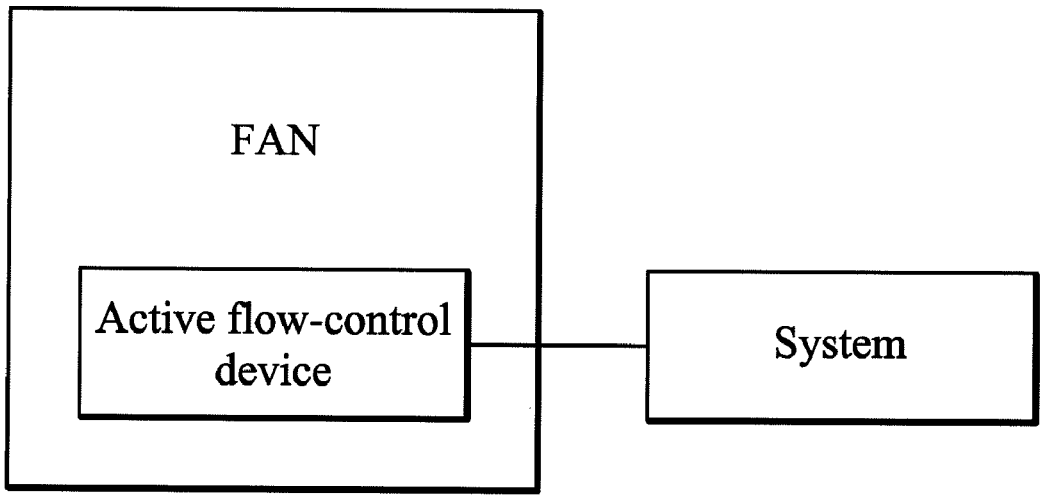
FIG. 7 shows a schematic illustration of an embodiment according to the present invention.

The active flow-control device 110 is disposed within the fan frame 102 to actively adjust the size of one of the air outlets 106, 108. The active flow-control device 110 is disposed between the air outlets 106, 108. That is, the active flow-control device 110 is at the tongue 114 of the fan frame 102. By rotating, pivoting or sliding the active flow-control device 110, the sizes of the air outlets 106, 108 are easily adjusted. The active flow-control device 110 is driven by a system (e.g. electromagnetism, gear or a motor), as shown in FIG. 7. In the embodiment, when temperature of the heat source near the air outlet 106 is higher than that of the heat source near the air outlet 108, the system, the fan 100, or the active flow-control device 110 actively adjusts or controls the position of the active flow-control device 110 in such a way to rotate the active flow-control device 110 toward the air outlet 108, thereby increasing the size of the air outlet 106 and/or decreasing the size of the air outlet 108.

Figure 2:
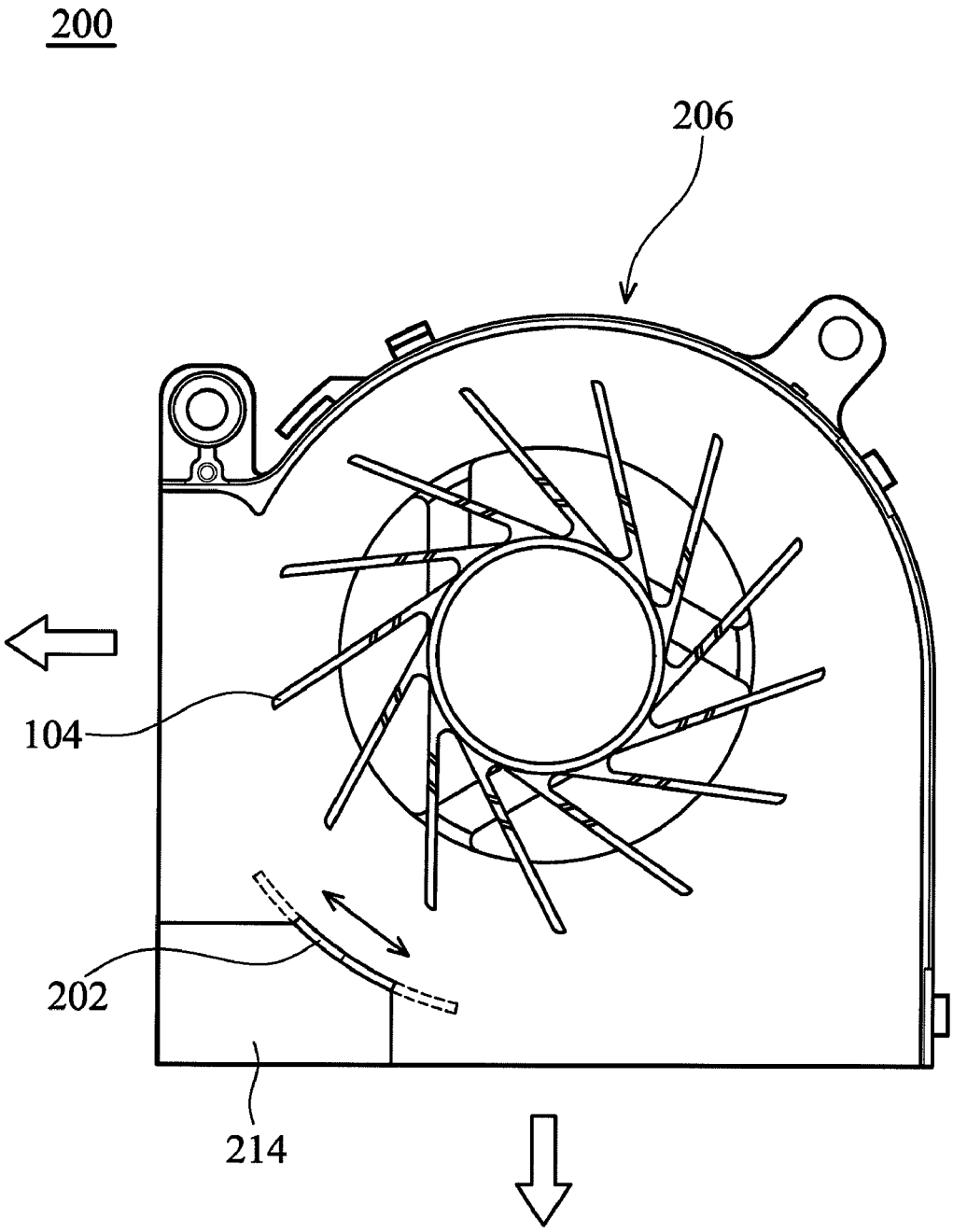
FIG. 2 is a schematic illustration of a second embodiment of the fan.

FIG. 2 is a schematic illustration of a second embodiment of the fan 200 of the present invention. The difference between the first and the second embodiments is that the active flow-control device 202 moves on the tongue 214 for changing the size of at least one of the two air outlets.

Figure 3:
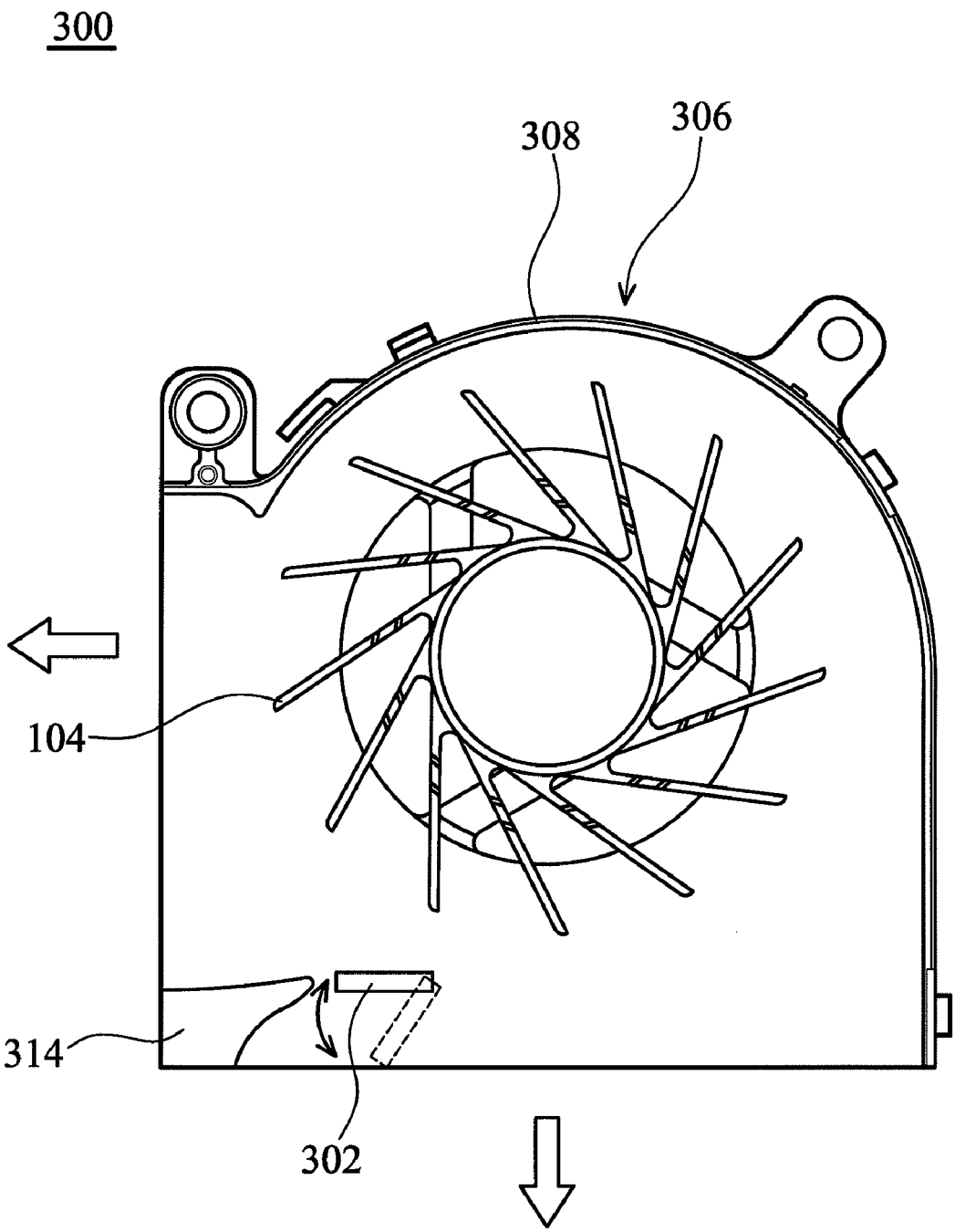
FIG. 3 is a schematic illustration of a third embodiment of the fan.

FIG. 3 is a schematic illustration of a third embodiment of the fan 300 of the present invention. The fan 300 is different from the fans in the previous embodiment in that the active flow-control device 302 is disposed within fan frame 306 near the tongue 314 of the fan frame 306. Specifically, the active flow-control device 302 is disposed at the air outlet of the fan frame 306. Meanwhile, the active flow-control device 302 moves, pivots, slides or rotates on the fan frame 306 to actively adjust the size of at least one of the air outlets according to demand.

Figure 4:
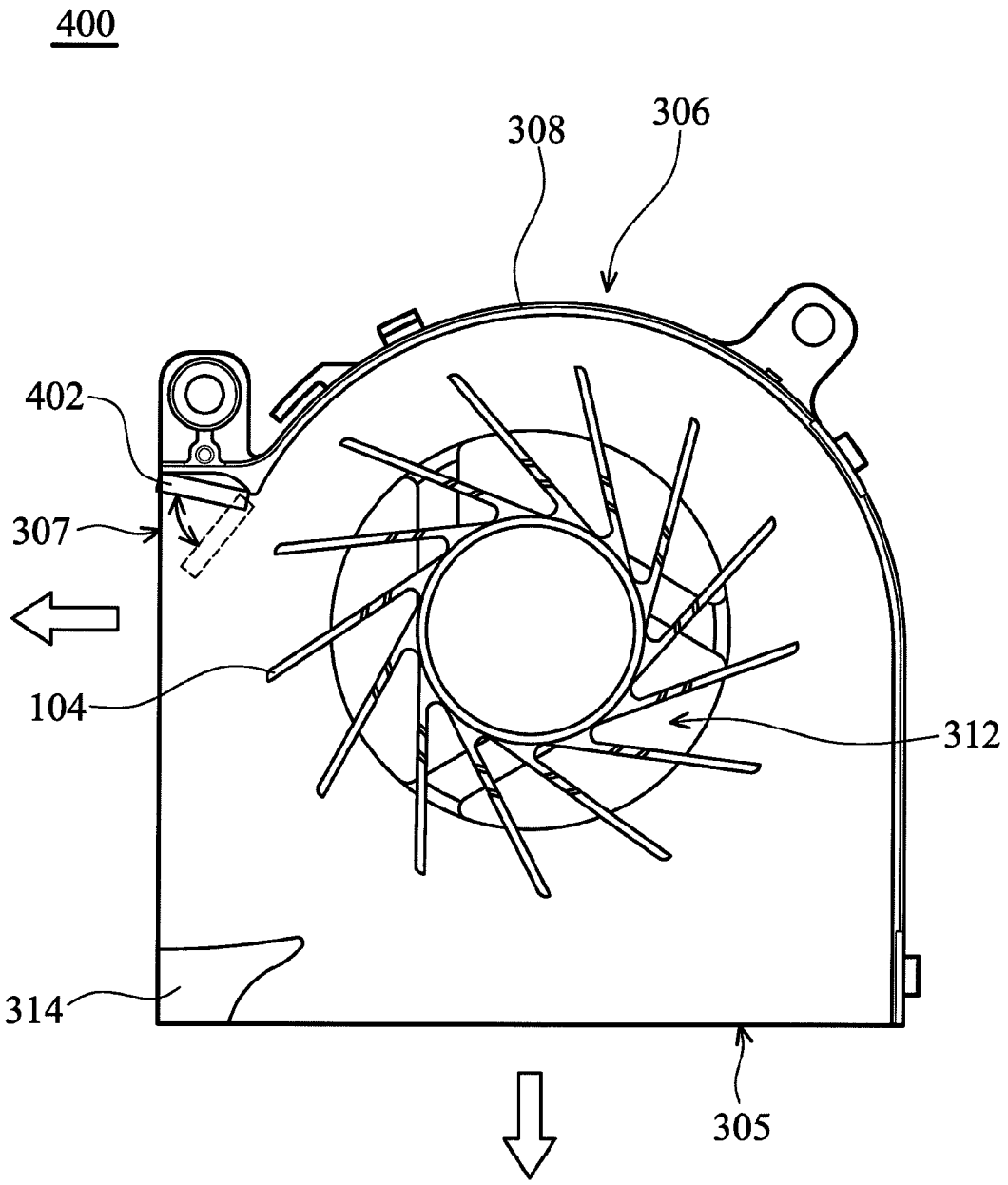
FIG. 4 is a schematic illustration of the fourth embodiment of fan.

Furthermore, as shown in FIG. 4, FIG. 4 is a schematic illustration of a fourth embodiment of the fan 400. The active flow-control device 402 can also be disposed within the fan frame 306 near a side wall 308 of the fan 400. In particular, the active flow-control device 402 is disposed at the air outlet of the fan frame 306. Meanwhile, the active flow-control device 402 moves, pivots, slides or rotates on the fan frame 306 to actively adjust the size of the air outlet according to demand.

Figure 5A:
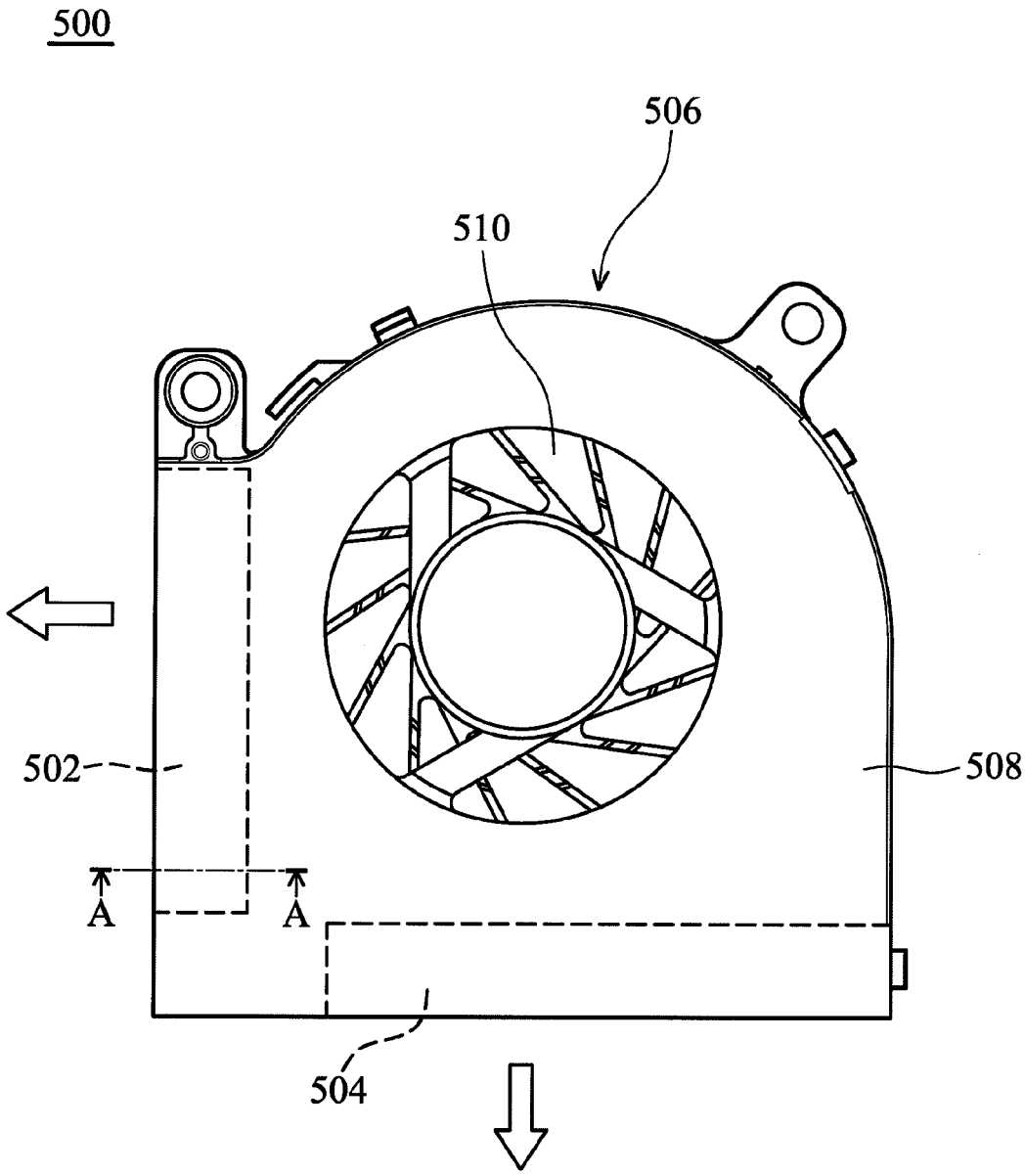
FIG. 5A is a schematic illustration of a fifth embodiment of the fan.
Figure 5B:
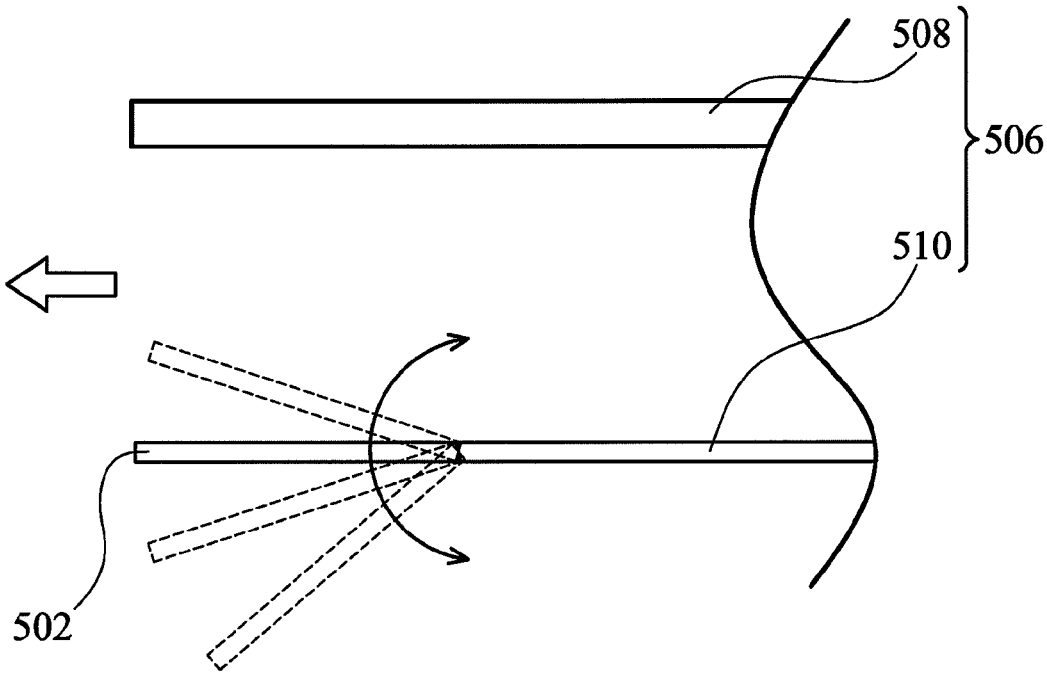
FIG. 5B is a sectional view along line A-A of the fan in FIG. 5A.

FIG. 5A is a schematic illustration of a fifth embodiment of the fan 500 of the present invention and FIG. 5B is a sectional view along line A-A of the fan 500 in FIG. 5A. The fan 500 is different from the fans in the previous embodiment in that the fan frame 506 of the fan 500 includes a top plate 508 and a bottom plate 510, and the active flow-control devices 502, 504 are disposed at the top plate 508 or the bottom plate 510, respectively. Meanwhile, the active flow-control devices 502, 504 moves, pivots, slides or rotates on the top plate 508 or the bottom plate 510 to actively adjust the size of at least one of the air outlets according to demand.

Figure 6:
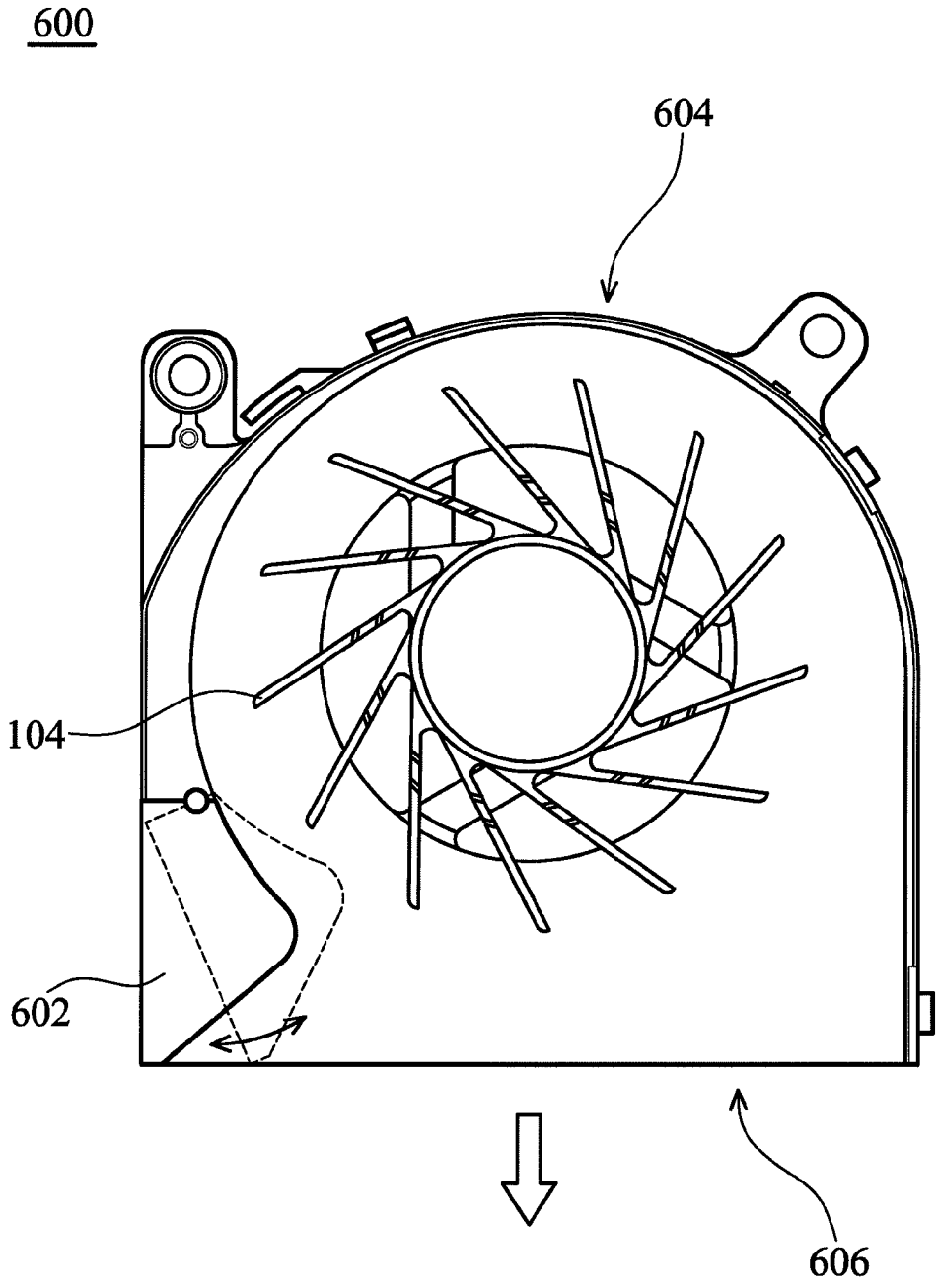
FIG. 6 is a schematic illustration of a sixth embodiment of the fan.

In the previously described embodiments, the fan includes two air outlets, but it is not limited thereto. The fan of the present invention can include only one air outlet, three air outlets or more than three air outlets. Referring to FIG. 6, the fan frame 604 of the fan 600 only has one air outlet 606, and the active flow-control device 602 is disposed thereon. The active flow-control device 602 moves, pivots, slides or rotates on the fan frame 604 to actively adjust the size of the air outlet 606 according to demand.

The active flow-control device of the present invention is not limited to be disposed at the air outlet of the fan; it can also be disposed at the air inlet of the fan to actively adjust the size of the air inlet. The air inlet is not limited to one; it can be two or more than two. Moreover, the active flow-control device can be disposed at the air outlet, the tongue of the fan frame, the top plate of the fan frame, the bottom plate of the fan frame or between the two air outlets.

In the previous embodiments, the fan only includes a single active flow-control device, but it is not limited thereto. The fan can include two or more than two active flow-control devices at the same time. Meanwhile the active flow-control devices are all disposed at the same air outlets, or disposed at different air outlets or air inlets.

As described above, because the active flow-control devices are disposed at the air outlets of the fan, such that the size of the air outlets can be adjusted during operation of the system, energy waste and noise are reduced and the lifetime of the fan is extended.

While the present invention has been described by way of example:and in terms of preferred embodiment, it is to be understood that the present invention is not limited thereto. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A fan, comprising at least one fan frame, comprising at least two air outlets;

at least one impeller disposed in the frame; and at least one active flow-control device disposed at the fan frame, for adjusting sizes of at least one of the two air outlets, wherein the active flow-control device is on a tongue of the fan frame and configured to move in a swinging manner to alternatively adjust the sizes of the two air outlets.

2. The fan as claimed in claim 1, wherein the active flow-control device is driven by electrical magnetism, gear or a motor.

3. The fan as claimed in claim 1, wherein when a heat source at one of the two air outlets has higher temperature than another heat source at the other of the two air outlets, the active flow-control device increases the size of one of the two air outlets or decreases the size of the other of the two air outlets.

4. The fan as claimed in claim 1, wherein the fan is a centrifugal fan and the impeller comprises at least one curved or plate-shaped blade.

5. The fan as claimed in claim 1, wherein the active flow-control device is controlled by a system.

6. The fan as claimed in claim 1, wherein the active flow-control device is arranged between the at least two air outlets.

7. The fan as claimed in claim 1, wherein the active flow-control device is configured to at least partially overlap with the at least two air outlets, respectively, so that during the swinging movement, the active flow-control device increases the size of one air outlet while decreasing the size of the other air outlet simultaneously.

* * * * *